US006059638A

United States Patent [19]

Crevasse et al.

[11] Patent Number: 6,059,638

[45] Date of Patent: May 9, 2000

[54] MAGNETIC FORCE CARRIER AND RING FOR A POLISHING APPARATUS

[75] Inventors: Annette M. Crevasse; William G. Easter; John A. Maze; Frank Micelli; Jose O. Rodriguez, all of Orlando, Fla.

[73] Assignee: Lucent Technologies Inc., Murray Hill, N.J.

[21] Appl. No.: 09/237,082

[22] Filed: Jan. 25, 1999

[51] Int. Cl.[7] ..... B24B 7/22

[52] U.S. Cl. ..... 451/41; 451/288

[58] Field of Search ..... 451/288, 287, 451/41, 9, 36, 290, 11, 550, 905, 494

[56] References Cited

U.S. PATENT DOCUMENTS

| | | | |
|---|---|---|---|
| 3,801,293 | 4/1974 | Kiser | 451/296 |
| 4,222,204 | 9/1980 | Benner | 451/508 |

*Primary Examiner*—Robert A. Rose

[57] ABSTRACT

The present invention provides a polishing apparatus having a drive motor, a carrier head and a polishing platen with a magnetic region formed in either the carrier head or the polishing platen. The magnetic region is configured to create an attracting force between the carrier head and the polishing platen. The drive motor is capable of producing a rotational polishing force. The carrier head is configured to retain an object to be polished, while the polishing platen has a polishing pad and is juxtaposed the carrier head.

20 Claims, 2 Drawing Sheets

135
339
339
130
131
170
338
371
NN
NNNNNNNNNNN
NNNNN
NN
133
140
342
110
SSSS

MAGNETIC FORCE CARRIER AND RING FOR A POLISHING APPARATUS

TECHNICAL FIELD OF THE INVENTION

The present invention is directed, in general, to a polishing apparatus and, more specifically, to a magnetic polishing head and retaining ring for polishing semiconductor wafers.

BACKGROUND OF THE INVENTION

In the manufacture of microcircuit dies, chemical/mechanical polishing (CMP) is used to provide smooth topographies of the semiconductor wafers for subsequent lithography and material deposition. Briefly, the CMP process involves holding and rotating a thin, reasonably flat, semiconductor wafer while pressing the wafer against a rotating polishing surface or platen. The semiconductor wafer is held in a carrier that has a carrier ring about its periphery to restrain the wafer to a position under the carrier. The polishing surface is wetted by a chemical slurry, under controlled chemical, pressure, and temperature conditions. The chemical slurry contains a polishing agent, such as alumina or silica, which is used as the abrasive material. Additionally, the slurry contains selected chemicals which etch or oxidize specific surfaces of the wafer during processing. The combination of mechanical and chemical removal of material during polishing results in superior planarization of the polished surface.

During polishing, a downward vertical force is applied to the carrier head through a gimbal by a load cell mounted on the carrier head drive shaft. The gimbal is essential in this design to allow the carrier head to conform to undulations of the polishing platen. Of course, the inclusion of a load cell on the carrier head drive shaft adds mass to a rotating system, thus complicating system balance. The total force applied by the load cell is generally distributed over the area of the wafer by the gimbal.

A polishing pad that rests on the surface of the polishing platen receives and holds the chemical slurry during polishing. As the platen and pad are rotated in contact with the wafer, the flexible polishing pad tends to develop a ripple near the edge of the carrier head. Because of the extremely small tolerances necessary in semiconductor manufacture, it is important to maintain the planarity of the wafer. In order to avoid rounding the edges of the wafer through contact with the ripple, the carrier ring may be extended toward the polishing pad with pneumatic pressure to force the ripple outward toward the circumference of the carrier ring and away from the wafer. This system is generally complex and expensive to maintain while less accurate than is desired for high-precision semiconductor manufacture.

Accordingly, what is needed in the art is a simpler apparatus and method to apply the forces necessary for chemical/mechanical polishing of semiconductor wafers.

SUMMARY OF THE INVENTION

To address the above-discussed deficiencies of the prior art, the present invention provides a polishing apparatus having a drive motor, a carrier head and a polishing platen with a magnetic region formed in either the carrier head or the polishing platen. The magnetic region is configured to create an attracting force between the carrier head and the polishing platen. The drive motor is capable of producing a rotational polishing force. The carrier head is configured to retain an object to be polished, while the polishing platen has a polishing pad and is juxtaposed the carrier head.

In one alternative embodiment, the magnetic region includes a first magnetic region formed in the carrier head and a second magnetic region formed in the polishing platen. The first magnetic region and the second magnetic region are configured to produce opposite magnetic polarities, thereby to create the attracting force.

The carrier head, in another embodiment, includes a retaining ring configured to retain the object to be polished. In an advantageous aspect of this embodiment, the magnetic region is located in the retaining ring.

In other embodiments, the magnetic region may be a permanent magnetic region, or an electromagnetic region. In a preferred embodiment, the attracting force is adjustable by controlling a current in the electromagnetic region. In yet other embodiments, the rotational polishing force is applied to the polishing platen or the carrier head. In a particularly advantageous embodiment, the object to be polished is a semiconductor wafer.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
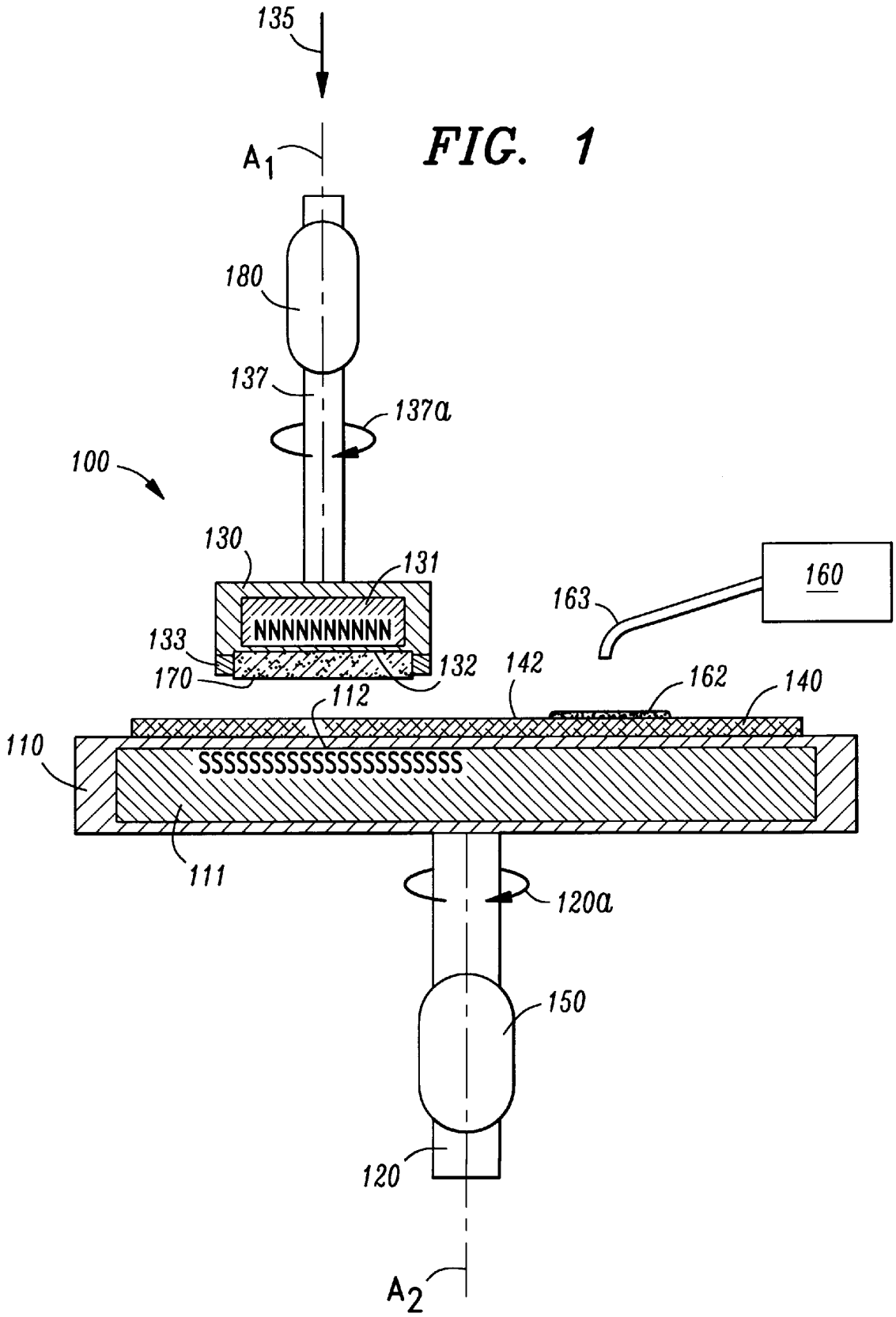
FIG. 1 illustrates an expanded schematic elevational view of an exemplary embodiment of a CMP apparatus constructed according to the principles of the present invention.

Referring initially to FIG. 1, illustrated is an expanded schematic elevational view of an exemplary embodiment of a CMP apparatus constructed according to the principles of the present invention. The CMP apparatus, generally designated 100, comprises a polishing platen 110, a first rotatable shaft 120, a carrier head 130 having a carrier ring 133, a polishing pad 140, a first drive motor 150, a temperature controlled reservoir 160 for slurry delivery, a second rotatable shaft 137, and a second drive motor 180. The polishing pad 140 provides a polishing surface 142 upon which a slurry 162 is deposited for polishing an object 170. The polishing platen 110 is substantially horizontal and acts as a surface against which the object 170 may be planarized. In an advantageous embodiment, the object 170 is a semiconductor wafer. Thus, this particular embodiment is quite useful in the fabrication of integrated circuits formed on semiconductor wafers.

It should be noted that the embodiment described in FIG. 1 includes magnetic regions in both the carrier head 130 and the polishing platen 110. However, it should be recognized that embodiments may also be constructed with a single magnetic region in the carrier head 130 while constructing the opposing body, such as the polishing platen 110, of a magnetically responsive material, e.g., steel. Similarly, embodiments can be constructed with a single magnetic region in the polishing platen 110 while the carrier head 130 or retaining ring 133 is constructed of the magnetically responsive material.

The rotatable shaft 137 is coupled to the carrier head 130 and has an axis $A_1$ that is substantially normal to the polishing surface 142. In the embodiment illustrated in FIG. 1, the carrier head 130 comprises a first magnetic region 131 and is rotatable by the rotatable shaft 137 about the axis $A_1$. The first magnetic region 131 may be a permanent magnetic region comprising a material such as lodestone. In another embodiment, the first magnetic region 131 may be a soft magnetic material, such as dead annealed iron. Alternatively, the magnetic region may be electromagnetic in nature, which allows for a variation in the strength of a magnetic force 135 by varying an electrical current through the electromagnetic region 131. This provides distinct advantages over conventional polishing apparatuses because the ability to vary the strength of the magnetic field allows the operator to more precisely adjust the polishing force 135. This, in turn, allows an operator to achieve a more accurately polished object. This increased manufacturing precision can be particularly important in the fabrication of present day semiconductor wafers and devices where material thicknesses have reached critical dimensions that require more accurate polishing techniques. By way of example, the electromagnetic properties within the electromagnetic region 131 may be induced by a magnetic coil that is formed in either the carrier head 130 or the polishing platen 110. The magnetic coil may be connected to power source (not shown) through a rheostat that allows precise control of current flow through the magnetic coil.

The first magnetic region 131 is so configured that a surface 132 of the region 131 is a magnetic pole of a specific polarity, e.g., a north magnetic pole, as shown. The carrier head 130 further comprises a retaining ring 133 that is configured to retain the semiconductor wafer 170 during polishing. The rotatable shaft 137 and carrier head 130 are mounted to the second drive motor 180 for continuous rotation about axis $A_1$ in a direction indicated by arrow 137*a*.

The polishing platen 110, as illustrated in FIG. 1, comprises a second magnetic region 111 and is rotatable by the rotatable shaft 120 about an axis $A_2$. Similarly, the second magnetic region 111 may be a permanent magnetic region, a soft magnetic region, or an electromagnetic region. The second magnetic region 111 is so configured that a surface 112 of the region 111 proximate the first magnetic region 131 is a magnetic pole of a specific polarity opposite the magnetic polarity of the surface 132 of the first magnetic region 131, i.e., a south magnetic pole, as shown. Of course, the exact polarity chosen for the first magnetic region 131 or second magnetic region 111 is not important so long as the regions 111, 131 present opposite polarities to each other. One who is skilled in the art is familiar with the property of opposite magnetic poles attracting one another. Therefore, the attractive force 135 is created between the first and second magnetic regions 131, 111 and the carrier head 130 and polishing platen 110 to which the magnetic regions 131, 111 are attached, respectively. The first and second magnetic regions 131, 111 may both be electromagnetic or permanent magnetic regions. However, in a particularly advantageous embodiment, current may be varied through the electromagnetic regions 111, 131 so that a desired magnitude of the attractive force 135 is exerted on the semiconductor wafer 170 and may be controlled as needed. One who is skilled in the art is familiar with changing the properties of an electromagnet by varying current therethrough.

The semiconductor wafer 170, by way of the carrier head 130 and the rotatable shaft 137, is engageable against the polishing pad 140. In an advantageous embodiment, the carrier head 130 further comprises the retaining ring 133 that prevents the semiconductor wafer 170 from fleeing the carrier head 130 under the forces of rotation. One who is skilled in the art will readily recognize that the illustrated embodiment employing two drive motors is only one of several ways for implementing rotation of the carrier head 130 and polishing platen 110, and in no way limits the scope or intent of the present invention.

When in the polishing position, the faces of the carrier head 130 and the semiconductor wafer 170 have an operating angle substantially normal to the rotatable shaft 137; that is the operating angle is between about 85° and 90° as measured from the axis $A_1$. In an alternative embodiment, the polishing platen 110 is coupled to and rotated by the first rotatable shaft 120 driven by the first motor 150. The polishing platen 110 and first rotatable shaft 120 are rotated about an axis $A_2$ that is substantially parallel to the axis $A_1$. In a particular aspect of this embodiment, the second rotatable shaft 137 and the first rotatable shaft 120 rotate in the same direction indicated by arrows 137*a*, 120*a*, respectively. However, one who is skilled in the art will readily recognize that directions of rotation of the carrier head 130 and polishing platen 110 do not limit the scope of the present invention. The polishing slurry 162, containing an abrasive such as silica or alumina particles suspended in either a basic or an acidic solution, is dispensed onto the polishing surface 142 through a conduit 163 from the temperature controlled reservoir 160.

Figure 2A:
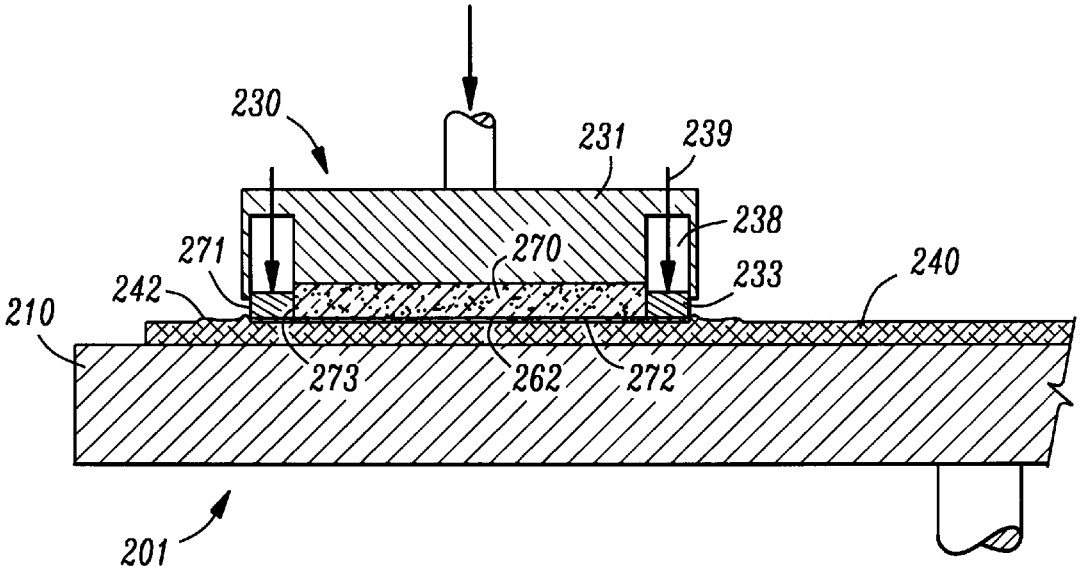
FIG. 2A PRIOR ART
FIG. 2A illustrates a simplified, enlarged sectional view of a conventional carrier head and conventional polishing platen during polishing.

Referring now to FIG. 2, illustrated is a simplified, enlarged sectional view of a conventional carrier head and conventional polishing platen during polishing. As shown, a conventional carrier head 230 comprises a carrier body 231, a retaining ring 233, and a pneumatic interface 238. A conventional polishing surface 201 comprises a polishing platen 210, and a polishing pad 240. During polishing, the polishing pad 240 will develop a ripple 242 at a free edge 271 of whatever surface 272 is being polished. One who is skilled in the art is familiar with the ripple 242 effect on the polishing pad 240 as the carrier head 230, semiconductor wafer 270, polishing platen 210, and polishing pad 240 rotate during polishing. In the illustrated embodiment, the free edge 271 contacted is on the retaining ring 233 that is being forced against the polishing pad 240 by a force 239 generated by the pneumatic interface 238. In addition to retaining the wafer 270 under the carrier head 230, the retaining ring 233 prevents the ripple 242 from contacting an outer edge 273 of the semiconductor wafer 270 and rounding the outer edge 273. As the pad 240 retains the polishing slurry 262, any contact of the pad 240 with the wafer 270 will result in material removal from the wafer 270. Therefore, a pneumatic interface 238 is used to force the retaining ring 233 against the pad 240 and move the ripple 242 radially outward. The pneumatic interface 238 may be a relatively complicated system requiring pneumatic lines, seals and actuators (not shown) to assure the retaining ring 233 remains in contact with the polishing pad 240. Moreover, such pneumatic systems do not have the same degree of polishing control as the magnetic system provided by the present invention.

Figure 3:
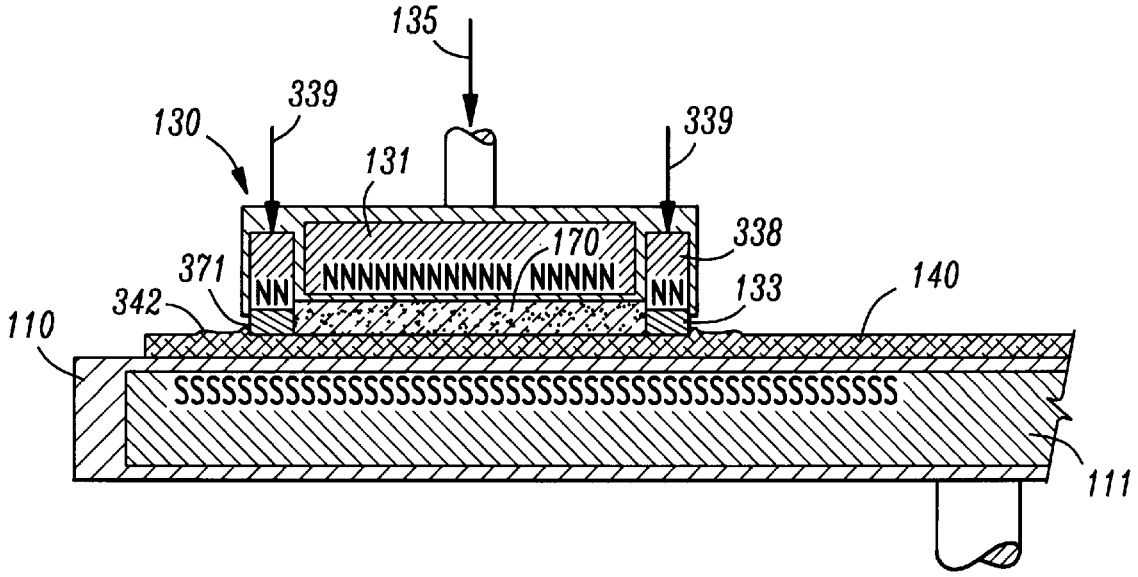
FIG. 3 illustrates an enlarged sectional view of the carrier head and polishing platen of FIG. 1.

Referring now to FIG. 3 with continuing reference to FIG. 1, illustrated is an enlarged sectional view of the carrier head and polishing platen of FIG. 1. In an advantageous embodiment, the carrier head 130 comprises the first magnetic region 131, the retaining ring 133, and a third magnetic region 338 within the retaining ring 133. In a manner similar to that of the first magnetic region 131, the third magnetic region 338 may be a permanent magnetic region or an electromagnetic region. As previously described, the polishing platen 110 comprises a second magnetic region 111 of an opposite magnetic polarity to the first magnetic region 131.

In a particularly advantageous embodiment, the third magnetic region 338 comprises an electromagnetic region, the strength of which can be controlled by an electric current. Therefore, a retaining ring attractive force 339 may be created between the third magnetic region 338 and the second magnetic region 111, thereby attracting the retaining ring 133 toward the polishing platen 110 and forcing a ripple 342 to an outer edge 332 of the retaining ring 133. Thus, creating the force 339 to control the vertical position of the retaining ring 133 is simplified by the present invention that can adjust the force 339 by controlling currents in the first or third magnetic regions 111, 338. Providing rotary electrical contacts, a feature well known in the art, and electrical current to the third magnetic region 338 is a significantly less difficult engineering problem than the prior art pneumatic system, discussed above in FIG. 2.

The previous discussion has emphasized the advantageous use of electromagnetic regions for the purposes of the disclosed invention. However, one who is skilled in the art will readily conceive of other combinations of electromagnetic, permanent magnetic, and soft magnetic regions to accomplish the same purposes while remaining within the broadest scope of the present invention.

Refer now simultaneously to FIGS. 1 and 3. To polish a semiconductor wafer 170, the wafer 170 is placed under the carrier head 130 and within the retaining ring 133. With a slurry 162 applied to the polishing pad 140, the carrier head 130 and polishing platen 110 are rotated as indicated at 137*a* and 120*a*. Electric current is fed to the first and second electromagnetic regions 131, 111, creating opposite magnetic polarities in the first and second electromagnetic regions 131, 111 and therefore a downward force 135 of the carrier head 130 against the polishing platen 110. Electric current may also be fed to the third electromagnetic region 338 so as to create a similar downward retaining ring force 339 that keeps the retaining ring 133 in contact with the polishing pad 140, thereby forcing the ripple 342 to an outermost edge 371 of the retaining ring 133 and protecting the semiconductor wafer 170.

Thus, a carrier head 130 and polishing platen 110 incorporating magnetic regions 131, 111, respectively, have been described that cooperate to provide an electrically adjustable polishing force 135 between the carrier head 130 and the polishing platen 110. This adjustable polishing force 135 may be more precisely controlled than the load cells of prior art by controlling a current in the electromagnetic regions 131, 111 within the carrier head 130 and the polishing platen 110, respectively. Similarly, a retaining ring 133 incorporating a third magnetic region 338 has been described that cooperates with the second magnetic region 111 to create an adjustable force 339 between the retaining ring 133 and the polishing platen 110. This force causes the ripple 342 of the polishing pad 140 to move radially outward to the outer edge 371 of the retaining ring 133 thereby protecting the semiconductor wafer 170 from edge rounding. Using a magnetic force simplifies the design of the retaining ring 133 by eliminating the pneumatic system of the prior art.

Although the present invention has been described in detail, those skilled in the art should understand that they can make various changes, substitutions and alterations herein without departing from the spirit and scope of the invention in its broadest form.

What is claimed is:

1. A polishing apparatus having a drive motor associated therewith to produce a rotational polishing force, comprising:

a carrier head configured to retain an object to be polished;

a polishing platen having a polishing pad and juxtaposed said carrier head; and a magnetic region formed in either of said carrier head or said polishing platen and configured to create an attracting force between said carrier head and said polishing platen, said attractive force drawing said carrier head against said polishing platen to provide a polishing force and thereby improve a polishing of said object.

2. The polishing apparatus as recited in claim 1 wherein said magnetic region includes a first magnetic region formed in said carrier head and a second magnetic region formed in said polishing platen, said first magnetic region and said second magnetic region configured to produce opposite magnetic polarities and thereby to create said attracting force.

3. The polishing apparatus as recited in claim 1 wherein said carrier head includes a retaining ring configured to retain said object to be polished.

4. The polishing apparatus as recited in claim 3 wherein said magnetic region is in said retaining ring.

5. The polishing apparatus as recited in claim 1 wherein said magnetic region is selected from the group consisting of:

a permanent magnetic region;

a soft magnetic region; and an electromagnetic region.

6. The polishing apparatus as recited in claim 5 wherein said attracting force is adjustable by controlling a current in said electromagnetic region.

7. The polishing apparatus as recited in claim 1 wherein said rotational polishing force is applied to said polishing platen or said carrier head.

8. The polishing apparatus as recited in claim 1 wherein said object to be polished is a semiconductor wafer.

9. A method of manufacturing a polishing apparatus, comprising:

forming a carrier head configured to retain an object to be polished;

forming a polishing platen having a polishing pad associated therewith;

forming a magnetic region in either of said carrier head or said polishing platen;

juxtaposing said carrier head and said polishing platen;

configuring said magnetic region to create an attracting force between said carrier head and said polishing platen, said attractive force drawing said carrier head against said polishing platen to provide a polishing force and thereby improve a polishing of said object; and coupling said carrier head or said polishing platen to a drive motor.

10. The method as recited in claim 9 wherein forming a magnetic region includes:

forming a first magnetic region in said carrier head;

forming a second magnetic region in said polishing platen; and configuring proximate faces of said first magnetic region and said second magnetic region with opposite magnetic polarities thereby creating said attracting force.

11. The method as recited in claim 9 wherein forming a carrier head includes forming a retaining ring configured to retain said object to be polished.

12. The method as recited in claim 9 wherein forming a magnetic region includes forming a magnetic region selected from the group consisting of:

a permanent magnetic region;

a soft magnetic region; and an electromagnetic region.

13. The method as recited in claim 12 wherein creating an attracting force includes creating a variable attracting force that is adjustable by controlling a current in said electromagnetic region.

14. The method as recited in claim 9 wherein forming a carrier head includes forming a carrier head to retain a semiconductor wafer.

15. A method for polishing a semiconductor wafer with a polishing apparatus having a carrier head and a polishing platen, comprising:

retaining a semiconductor wafer within a cavity of said carrier head;

juxtaposing said semiconductor wafer against said polishing platen;

effecting a magnetic field in a magnetic region of said polishing apparatus, said magnetic field creating an attracting force between said carrier head and said polishing platen, said attractive force drawing said carrier head against said polishing platen to provide a polishing force and thereby improve a polishing of said semiconductor wafer; and polishing said semiconductor wafer against said polishing platen.

16. The method as recited in claim 15 wherein effecting a magnetic field includes:

effecting a first magnetic field in a first magnetic region formed in said carrier head;

effecting a second magnetic field in a second magnetic region formed in said polishing platen;

configuring proximate faces of said first magnetic region and said second magnetic region with opposite magnetic polarities thereby creating said attracting force.

17. The method as recited in claim 16 wherein effecting a first magnetic field includes effecting a first magnetic field in a retaining ring configured to retain said object to be polished.

18. The method as recited in claim 15 wherein effecting a magnetic field includes effecting said magnetic field in said magnetic region that is selected from the group consisting of:

a permanent magnetic region;

a soft magnetic region; and an electromagnetic region.

19. The method as recited in claim 18 wherein effecting a magnetic field includes adjusting said magnetic field by controlling a current in said electromagnetic region.

20. The method as recited in claim 15 wherein polishing said semiconductor wafer includes rotating said polishing platen or said carrier head.

* * * * *